US008006959B2

(12) United States Patent
Roudebush et al.

(10) Patent No.: US 8,006,959 B2
(45) Date of Patent: Aug. 30, 2011

(54) IGNITION SYSTEM FOR A PULSE FOG GENERATOR

(75) Inventors: Dennis A. Roudebush, Noblesville, TN (US); Justin D. Eros, Indianapolis, IN (US); Conrad D. McGinnis, Carmel, IN (US)

(73) Assignee: Curtis Dyna-Fog, Ltd., Westfield, IN (US)

( * ) Notice: Subject to any disclaimer, the term of this patent is extended or adjusted under 35 U.S.C. 154(b) by 0 days.

(21) Appl. No.: 12/860,798

(22) Filed: Aug. 20, 2010

(65) Prior Publication Data

US 2011/0165525 A1 Jul. 7, 2011

Related U.S. Application Data

(62) Division of application No. 12/042,604, filed on Mar. 5, 2008, now Pat. No. 7,798,474.

(51) Int. Cl.
*F02M 1/16* (2006.01)

(52) U.S. Cl. ..... 261/35; 239/5; 261/DIG. 8

(58) Field of Classification Search ..... 261/35, 261/69.1, DIG. 8; 123/3, 143 B, 143 C, 145 A, 123/179.11, 179.16, 179.28; 239/5, 129, 239/137, 138; 417/412
See application file for complete search history.

(56) References Cited

U.S. PATENT DOCUMENTS

| | | | |
|---|---|---|---|
| 1,120,635 | A | 12/1914 | Vidar |
| 1,423,418 | A | 7/1922 | Grikscheit |
| 1,496,432 | A | 6/1924 | Robinson |
| 1,677,729 | A | 7/1928 | Sams |
| 2,705,171 | A | 3/1955 | Ziherl |
| 3,307,836 | A | 3/1967 | Arndt et al. |
| 3,476,144 | A | 11/1969 | Krantz |
| 3,993,582 | A | 11/1976 | Curtis |
| 4,030,695 | A | 6/1977 | Curtis |
| 4,039,270 | A | 8/1977 | Hiraga |
| 4,047,851 | A | 9/1977 | Bender |
| 4,162,669 | A | 7/1979 | Igashira et al. |
| 4,177,949 | A | 12/1979 | Curtis et al. |
| 4,204,511 | A | 5/1980 | Morris |
| 4,271,093 | A | 6/1981 | Kobayashi |
| 4,343,719 | A | 8/1982 | Stevens et al. |
| 4,373,479 | A | 2/1983 | Billingsley et al. |
| 4,457,271 | A | 7/1984 | Fitch |
| 4,462,346 | A | 7/1984 | Haman et al. |
| 4,684,484 | A | 8/1987 | Guntly |
| 4,754,730 | A | 7/1988 | Campagna |
| 4,811,901 | A | 3/1989 | Stevens et al. |
| 4,862,847 | A | 9/1989 | Kobayashi et al. |

(Continued)

FOREIGN PATENT DOCUMENTS

| | | | |
|---|---|---|---|
| JP | 402215958 | A | 8/1990 |

(Continued)

*Primary Examiner* — Richard L Chiesa
(74) *Attorney, Agent, or Firm* — Bose McKinney & Evans LLP

(57) ABSTRACT

The present invention provides an ignition system for a pulse fog generator having a carburetor, a pump for pumping air into the carburetor, and a priming pump for directing a quantity of fuel into the carburetor. The ignition system includes an igniter operable on low voltage, a switch for activating and deactivating the igniter, and a grounding connection for grounding the igniter to the carburetor. The grounding connection can include an igniter bracket and a ground wire assembly which couples to the igniter and to a location substantially near a sparkplug of the pulse fog generator.

7 Claims, 7 Drawing Sheets

U.S. PATENT DOCUMENTS

| | | | | |
|---|---|---|---|---|
| 4,862,848 | A | 9/1989 | Kobayashi et al. | |
| 4,893,593 | A | 1/1990 | Sejimo et al. | |
| 4,893,594 | A | 1/1990 | Kobayashi | |
| 4,934,601 | A | 6/1990 | Stevens et al. | |
| 6,863,266 | B2 | 3/2005 | Krlin et al. | |
| 7,798,474 | B2 * | 9/2010 | Roudebush et al. | 261/35 |
| 2003/0062633 | A1 | 4/2003 | Woody | |
| 2006/0169237 | A1 | 8/2006 | Yang | |
| 2009/0224068 | A1 * | 9/2009 | Roudebush et al. | 239/128 |

FOREIGN PATENT DOCUMENTS

| | | | |
|---|---|---|---|
| JP | 403242455 | A | 10/1991 |

* cited by examiner

IGNITION SYSTEM FOR A PULSE FOG GENERATOR

RELATED APPLICATIONS

This application is a divisional of U.S. patent application Ser. No. 12/042,604, filed Mar. 5, 2008, now U.S. Pat. No. 7,798,474 which is hereby incorporated by reference in its entirety.

BACKGROUND

The present invention generally relates to the field of fogging devices. In particular, the invention is directed toward fogging devices utilizing the pulse-jet, or resonant intermittent combustion, principle.

Fogging devices, used to generate an insecticide fog, for example, and utilizing the pulse-jet or resonant intermittent combustion principle, are well known in the prior art. Examples of such devices are disclosed in U.S. Pat. No. 3,993,582 to Curtis, U.S. Pat. No. 4,030,695 to Curtis, and U.S. Pat. No. 4,343,719 to Stevens et al. Each of these patents discloses a fogging apparatus utilizing a resonant, intermittent combustion device, a fuel supply, a formulation supply, a formulation control device, and a starting device. In such prior art devices, the resonant intermittent combustion device is shut off by way of a valve located in the carburetor.

Fogging devices disclosed in U.S. Pat. No. 4,811,901 to Stevens et al. ("the '901 patent") and U.S. Pat. No. 4,934,601 to Stevens et al. ("the '601 patent"), both of which are hereby incorporated by reference into the present application, provide an improved starting system for the resonant intermittent combustion device, an improved combustion device shut off system, and an improved formulation control device over previous fogging devices. These fogging devices utilize ignition systems that generally require at least 12 volts DC for supplying power to ignite the fogging device. Additionally, these ignition systems are typically grounded via a single grounding means. However, there are potential safety concerns that exist with having only a single grounding means.

Accordingly, a need has arisen for improving the design of these fogging devices by implementing a secondary grounding means. In particular, there is a need for a pulse fog generator with an ignition system operating from a low voltage power source and at least one additional grounding means, which in combination, would reduce the overall weight of the machine, lower the cost of the machine, and eliminate wasted energy required for starting the machine.

SUMMARY OF THE INVENTION

One embodiment of the present invention provides an ignition system for a pulse fog generator in which the engine has a carburetor, a pump for pumping air into the carburetor, and a priming pump for directing a quantity of fuel into the carburetor. The ignition system includes an igniter which operates on low voltage and a frequency between 10-20 Hz, a switch for activating and deactivating the igniter, and a grounding connection for grounding the igniter to the carburetor.

In another embodiment, an ignition system for mounting to a chassis of a pulse fog generator is provided in which the pulse fog generator has a carburetor, a pump for pumping air into the carburetor, and a priming pump for directing a quantity of fuel into the carburetor. The ignition system comprises an igniter assembly having a switch for activating and/or deactivating the ignition assembly, an igniter bracket for grounding the igniter assembly to the chassis, and an ignition wire assembly that includes a first end and a second end. The first end of the wire assembly couples to the igniter assembly and the second end couples to a spark plug near the carburetor. Additionally, an igniter cap may couple to the igniter assembly and a low voltage power supply may supply power to the igniter assembly.

In a different embodiment of the present invention, a method is provided for igniting a pulse fog generator that comprises a carburetor, a pump for pumping air into the carburetor, a priming pump for directing a quantity of fuel into the carburetor, and an ignition system that includes an igniter which is operable on 1.5 volts DC at a frequency of 10 Hz. In this embodiment, the method includes actuating a lever on the carburetor to an open position, directing air and fuel to flow into the carburetor for ignition, triggering a switch on the ignition system, and igniting the pulse fog generator.

The present invention is explained in more detail hereinafter on the basis of advantageous embodiments shown in the figures. The special features shown therein may be used individually or in combination to provide embodiments of the present invention.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

Corresponding reference numerals are used to indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
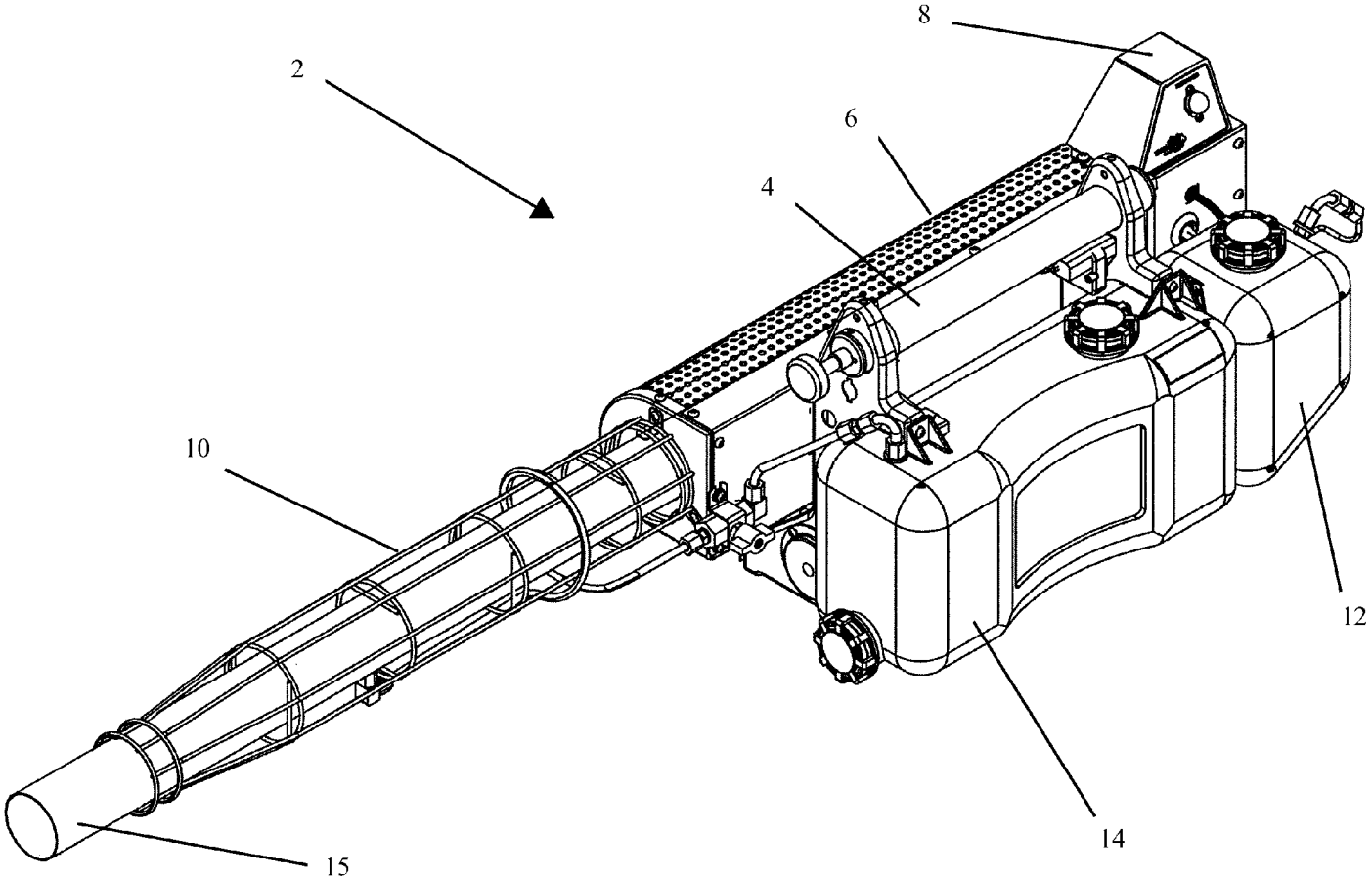
FIG. 1 is a perspective view of a pulse fog generator.

A pulse fog generator with a novel ignition assembly is shown in FIG. 1. The pulse fog generator 2 comprises an engine mounting assembly 6 and a carburetor (not shown)

which is enclosed by a carburetor cover assembly 8. The pulse fog generator 2 may operate from various types of fuel including propane, JP-8 jet fuel, kerosene, methanol, ethanol, diesel, and other special blends of fuel which facilitate the ignition process of the pulse fog generator 2. A fuel tank assembly 12 may be mounted to the pulse fog generator 2 for holding the fuel.

Figure 2:
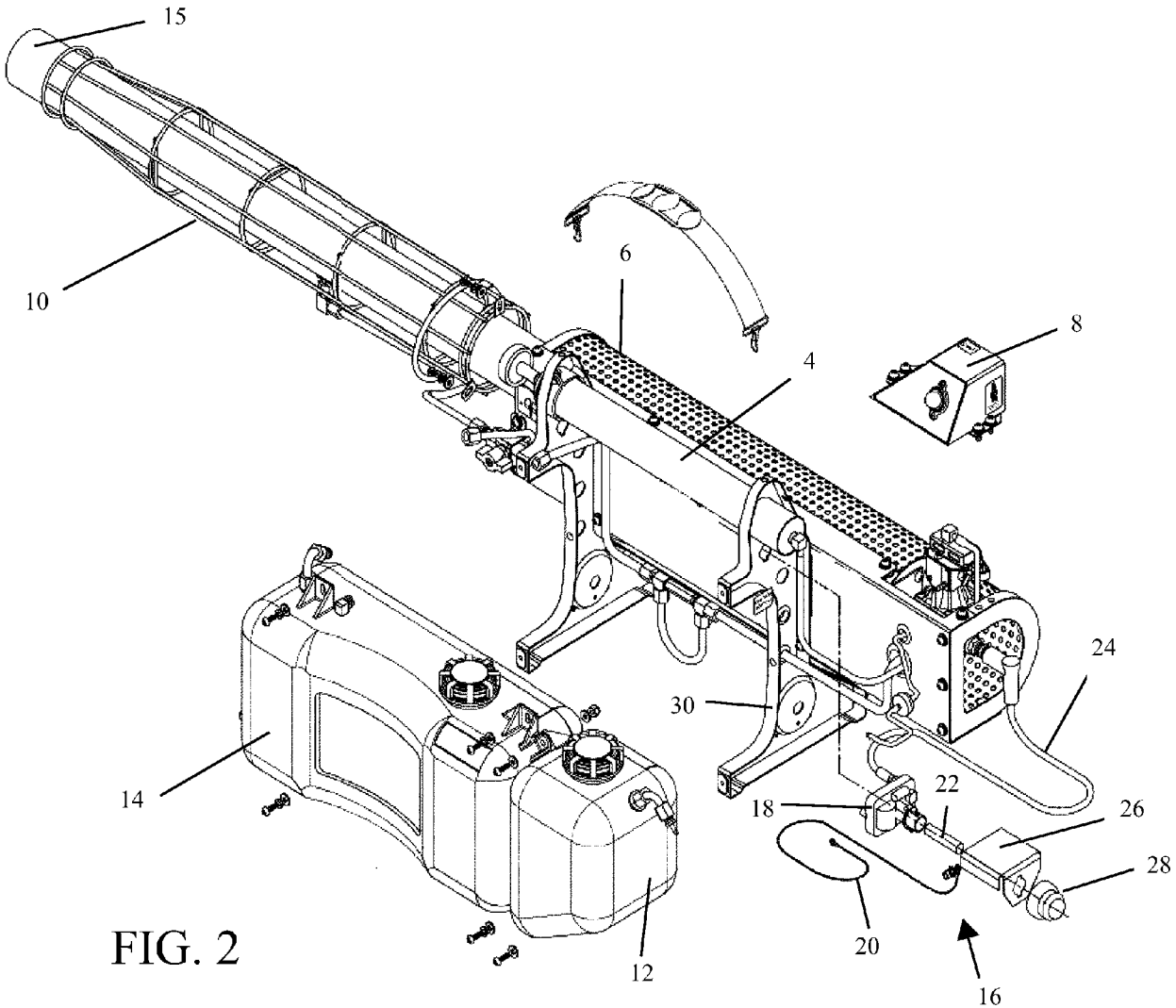
FIG. 2 is an exploded view of the pulse fog generator of FIG. 1.

In addition to fuel supply, an air supply assembly 4 may be mounted to the pulse fog generator 2 for supplying air to the ignition system 16 (see FIG. 2). The air supply assembly 4 may include any means known to one skilled in the art for supplying air. In one embodiment, the air supply assembly 4 may be an air compressor or an electrically-powered air pump. In a different embodiment, the air supply may be manually operated. In an advantageous embodiment, the air supply assembly 4 will supply the proper amount of air to mix with the fuel for igniting and operating the pulse fog generator.

In the pulse fog generator of FIG. 1, a formulation tank assembly 14 is provided and may be mounted to the pulse fog generator 2. One embodiment of the formulation tank assembly 14 that may be mounted to the pulse fog generator 2 is described in detail in U.S. Pat. No. 4,811,901, which as mentioned above, is incorporated by reference. As also shown in FIG. 1, a wire guard assembly 10 is provided for directing contents from the formulation tank assembly 14 to the surroundings. The wire guard assembly 10 may extend from the engine mounting assembly 6 and surround a tubular member 15 that dispenses the formulation.

An exploded view of the pulse fog generator 2 of FIG. 1 is illustrated in FIG. 2. Besides the components described above, the pulse fog generator 2 further comprises an ignition assembly 16 that will be described in greater detail below. In the embodiment of FIG. 2, the ignition assembly 16 includes an igniter 18 that may be powered by a low voltage power supply 22 that may provide less than 12 volts DC. In another embodiment, the low voltage power supply may provide between 1-5 volts DC. In a specific embodiment, the low voltage power supply provides 1.5 volts DC. In the various embodiments in which the power source is a battery, as in FIG. 2 for example, the igniter 18 may operate from a single AAA battery. The ability to start the pulse jet generator with a lower voltage power supply reduces waste consumption, saves energy, and helps with efforts geared toward recycling and improving the quality of the environment. In contrast, other fogger devices known in the art generally require 12 volts DC or more, because lower input to output voltage ratios cannot be used to ignite a pulse jet generator without tuning the engine to a proper range. Additionally, fogger devices known to those skilled in the art rely on pressurizing the fuel system, which prevent such fogger devices from being ignited using low input voltages. In contrast, the present invention incorporates a carburetor and primer bulb setup as described in U.S. Pat. No. 4,934,601, which as stated above, is incorporated by reference.

The ignition assembly 16 of FIG. 2 further comprises an ignition wire assembly 24 in which one end couples to a sparkplug (not shown) near the carburetor and a second end couples to the igniter 18. An igniter bracket 26 and igniter cap 28 are also provided, wherein the bracket 26 is generally used for grounding the ignition assembly 16 and the cap 28 may be depressed to ignite the ignition assembly 16. As will be described below with reference to FIG. 5, the igniter bracket 26 may function as a single means for grounding the ignition assembly 16, but mounting the igniter 18 to the igniter bracket 26 does not always produce the most optimal grounding condition. Therefore, to ground the pulse jet generator 2 in a more favorable manner, a ground wire assembly 20 may be used as a secondary or "emergency" means for grounding the ignition assembly 16.

Figure 3:
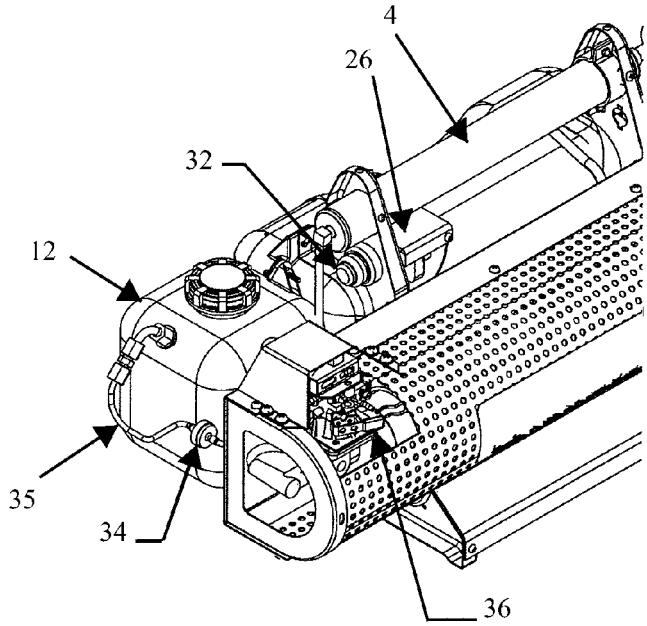
FIG. 3 is a partial perspective view of the first side of the pulse fog generator of FIG. 1.

In the embodiment of FIG. 3, a partial perspective view of the pulse fog generator 2 of FIG. 1 is shown. In this embodiment, the carburetor cover assembly 8 is removed and the ignition bracket 26 is shown mounted to the chassis 30 of the generator 2. The ignition switch 32 is also visible and it includes the igniter cap 28 as described with reference to FIG. 2 above. The ignition switch 32 may include any type of mechanism for igniting the ignition assembly 16. In the embodiment of FIG. 3, the ignition switch 32 may be pressed inwards. Other embodiments of the switch 32 may comprise levers, knobs, flip switches, turn-key, and other forms of switches known to the skilled artisan.

In the embodiment of FIG. 3, a typical fuel filter 34 is shown disposed at a location along a fuel delivery line 35. In general, the fuel delivery line 35 may supply fuel from the fuel tank assembly 12 to the carburetor. Also shown in FIG. 3 is a carburetor power switch assembly 36 which may be used for turning the pulse fog generator 2 on and/or off. In the embodiment shown in FIG. 3, this switch assembly 36 is shown as a lever, but as with the ignition switch 32, may comprise any form of a switch known to the skilled artisan. The carburetor power switch assembly 36 will be described in further detail with regard to FIG. 9 below.

Figure 4:
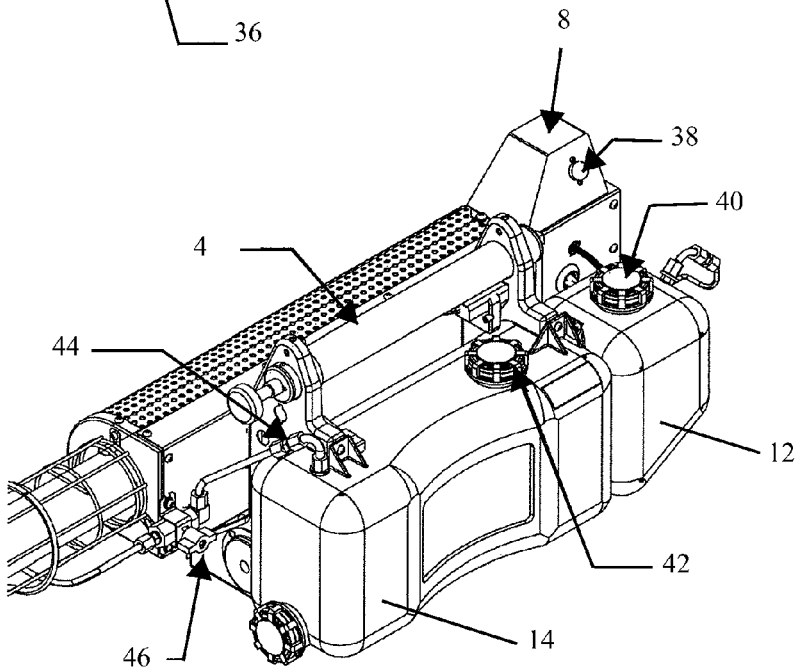
FIG. 4 is a partial perspective view of the second side of the pulse fog generator of FIG. 1.

With reference to the embodiment of FIG. 4, the fuel tank assembly 12 includes a fuel tank cap 40 and the formulation tank assembly 14 includes a formulation tank cap 42. As for distributing formulation from the formulation tank assembly 14, a flow-control orifice 44 and formulation on/off valve 46 may be provided to control the flow rate of formulation from the tank assembly 14. The formulation tank assembly 14 is described in more detail in U.S. Pat. No. 4,811,901, which as stated above, is herein incorporated by reference.

Figure 5:
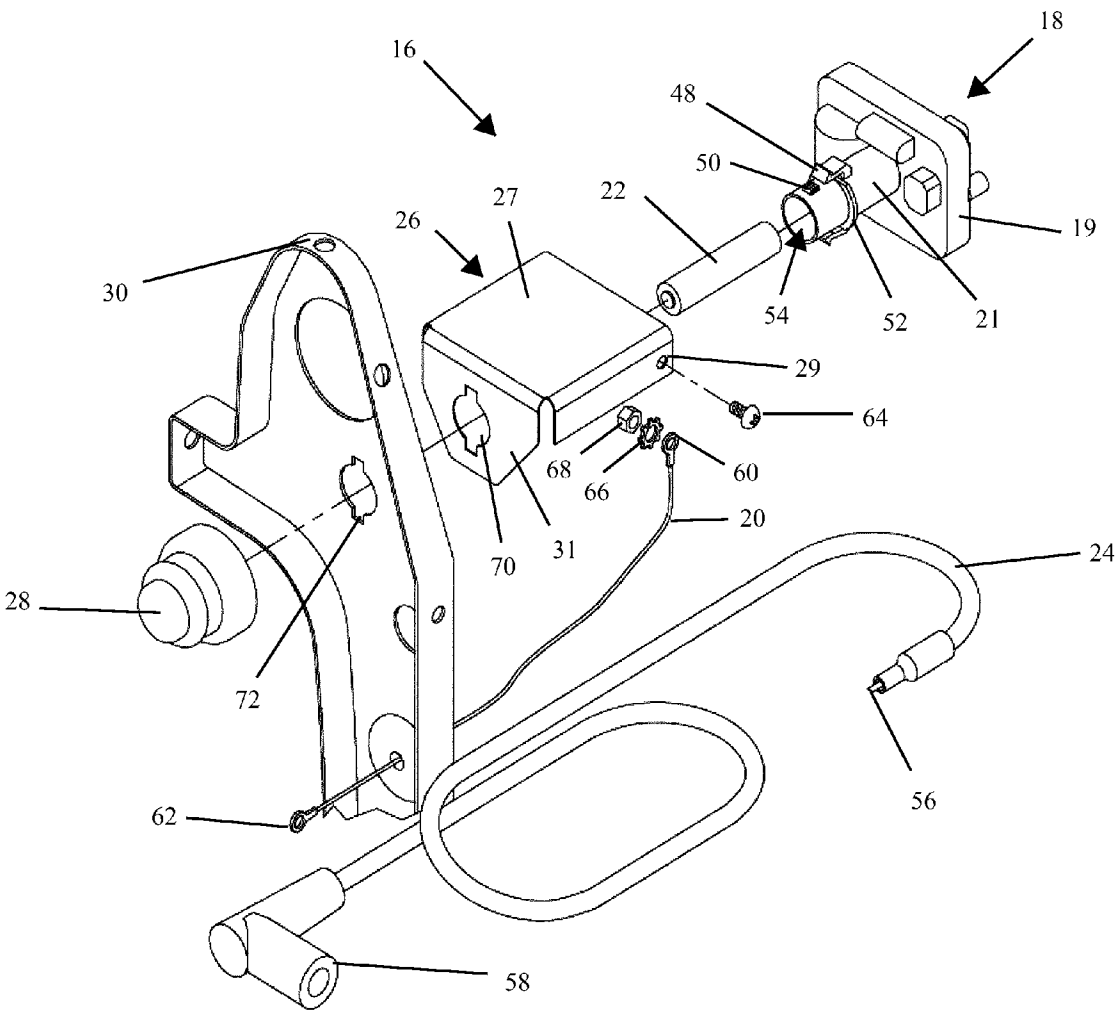
FIG. 5 is an exploded view of an ignition system of a pulse fog generator.

An exemplary embodiment of the ignition assembly 16 is shown as an exploded view in FIG. 5. In particular, the ignition assembly 16 may comprise an igniter 18 that operates with a low voltage power supply 22 such as a battery. The igniter 18 may include a holding compartment 54 in which the power supply 22 is held. The ignition assembly 16 further includes an igniter bracket 26. The bracket 26 may include a top surface 27, at least one side wall 29, and a front wall 31 that defines a bracket opening 70. In one embodiment, the bracket 26 is made from stainless steel. In alternate embodiments, the bracket 26 may be made from other materials known to the skilled artisan that would be conducive for grounding the igniter 18.

In addition to the bracket, the ignition assembly 16 further includes a cap 28, an ignition wire assembly 24, and a ground wire assembly 20. As previously described, the ignition wire assembly 24 is coupled between the igniter 18 and a spark plug (not shown). The ignition wire assembly 24 includes a first end 56 that may comprise a terminal strip for coupling to the igniter 18. A second end 58 of the ignition wire assembly 24 includes a coupler for connecting to a standard spark plug. As previously mentioned, the ground wire assembly 20 acts as a secondary means for grounding the ignition assembly 16. The ground wire assembly 20 includes a first end 60 for coupling to the igniter bracket 26 and a second end 62 for coupling at or near the sparkplug. Although the ground wire assembly 20 is provided as a secondary means for grounding the ignition assembly 16, it advantageously grounds the assembly 16 at a primary grounding point 158 (see FIG. 8) and thus improves the grounding of the overall device. The first end 60 of the ground wire assembly 20 may be coupled to the igniter bracket 26 via a plurality of fasteners including a nut 68, washer 66, and screw or bolt 64.

As briefly mentioned above, the ignition assembly 16 includes a first manner by which the igniter 18 is grounded to the chassis or main support reference 30, which is in addition to the ground wire assembly 20. As shown in FIG. 5, the igniter 18 may include a main body 19 with a nose 21 that extends from the main body 19. The nose 21 may comprise a plurality of clips 48, a threaded portion 50, and a flange 52 that protrudes from the nose 21 by approximately ⅛ inch. The flange 52 circumscribes the nose 21 and the holding compartment 54. Although not shown in FIG. 5, a thin wire extends away from the flange 52 and contacts the chassis or main support frame 30 to ground the igniter 18. In one embodiment, the wire may be 0.030-040" in diameter.

As shown in FIG. 5, the power source 22 may be inserted into the holding compartment 54 of the igniter 18. The igniter bracket 26 can then slide over the top of the igniter 18 such that the nose 21 slides through the bracket opening 70. The bracket opening 70 may be configured as a round opening with square-like cutouts at two or more locations along the diameter of the opening 70. The clips 48 of the igniter 18 may engage with these square-like cutouts in a snap-fit coupling. The nose 21 may also slide into a similarly-shaped opening 72 in the chassis 30 such that the clips 48 engage in a snap-fit coupling with the chassis 30. As the igniter 18 couples with the chassis 30, the thin wire may contact a metal surface of the chassis to ground the igniter 18. Unfortunately, this type of grounding may be susceptible to a wobbly and/or loose coupling between the igniter 18, the bracket 26, and the chassis 30 such that the ignition assembly 16 is not properly grounded. For this reason, the ground wire assembly 20 described above is incorporated into the ignition assembly 16. Finally, the igniter cap 28 may comprise a deformable material that allows a user to depress the cap inward and internal threads that screw onto the threaded portion 50 of the igniter 18. Thus, the cap 28 forms a portion of the ignition switch 32.

Figure 6:
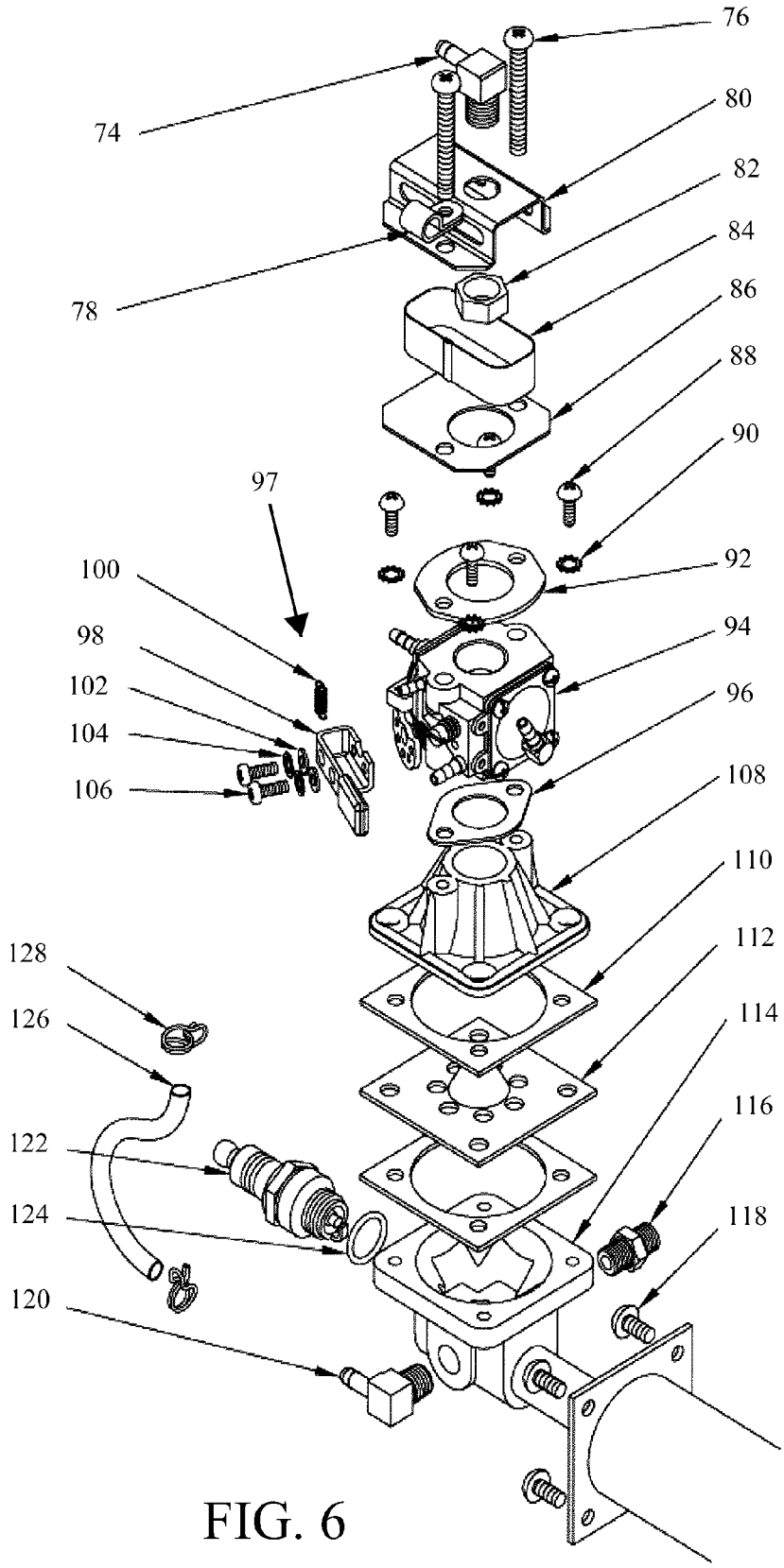
FIG. 6 is an exploded view of a carburetor and antechamber assembly of a pulse fog generator.

A typical carburetor and antechamber assembly known to the skilled artisan is shown in FIG. 6. The carburetor assembly comprises a carburetor body 94, carburetor gaskets 92, 96, an air intake bottom plate 86, an air filter 84, and an air injection bracket 80. An elbow fastener 74 and nut 82 couples to the air injection bracket 80 and screws or bolts 76 secure a tube clamp 78, the air injection bottom plate 86, and gasket 92 to the carburetor body 94 and carburetor adapter 108. Additional screws or fasteners 88, 90 mount the carburetor adapter 108, a plurality of venturi gaskets 110, and a petal valve assembly 112 to the antechamber/engine assembly 114. An elbow 120, a connector 116, and other fasteners may be coupled to the antechamber/engine assembly 114. A sparkplug 122 is coupled to the antechamber/engine assembly 114 with at least one o-ring 124 disposed therebetween. The assemblies may further include tubing 126 that comprise a plurality of hose clamps 128 for attaching the tubing 126, for example, to one or more elbows 120. As mentioned above and as will be described in further detail with regards to FIG. 9 below, the carburetor assembly may be turned on and/or off via a lever assembly 97 as shown in FIG. 6. The lever assembly 97 is advantageous as it requires only a lever 98 and a spring 100. Fasteners including bolts or screws 106 and washers 102, 104 may be used for coupling the lever 98 and spring 100 to the carburetor body 94. Other embodiments of the carburetor assembly may include alternative means for turning on and off the carburetor.

Figure 7:
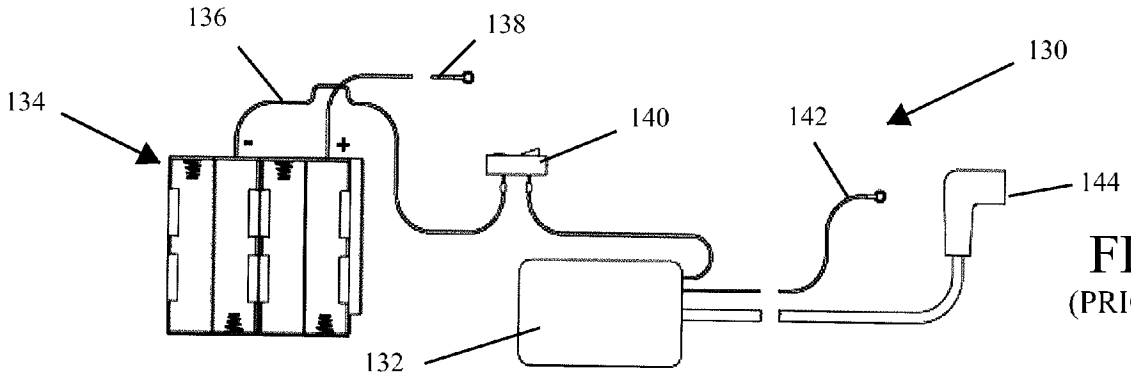
FIG. 7 (PRIOR ART)
FIG. 7 is a schematic view of a prior art ignition system for a fogger device operating with at least 12 VDC.

In the schematic of FIG. 7, a prior art ignition system for a fogger device is illustrated. In this schematic, the ignition system 130 is operable with at least a 12 VDC battery which is held in a battery holder 134. The battery may comprise eight D batteries, a motorcycle battery, or a similar source that supplies at least 12 VDC. A first wire 136 runs from the battery to an ignition switch 140 and a second wire 138 runs from the battery to ground. The ignition switch 140 is electrically coupled to a 12 VDC igniter 132. The igniter 132 includes a first wire 142 which connects to an antechamber (not shown) and a second wire 144 which connects to a sparkplug (not shown).

Figure 8:
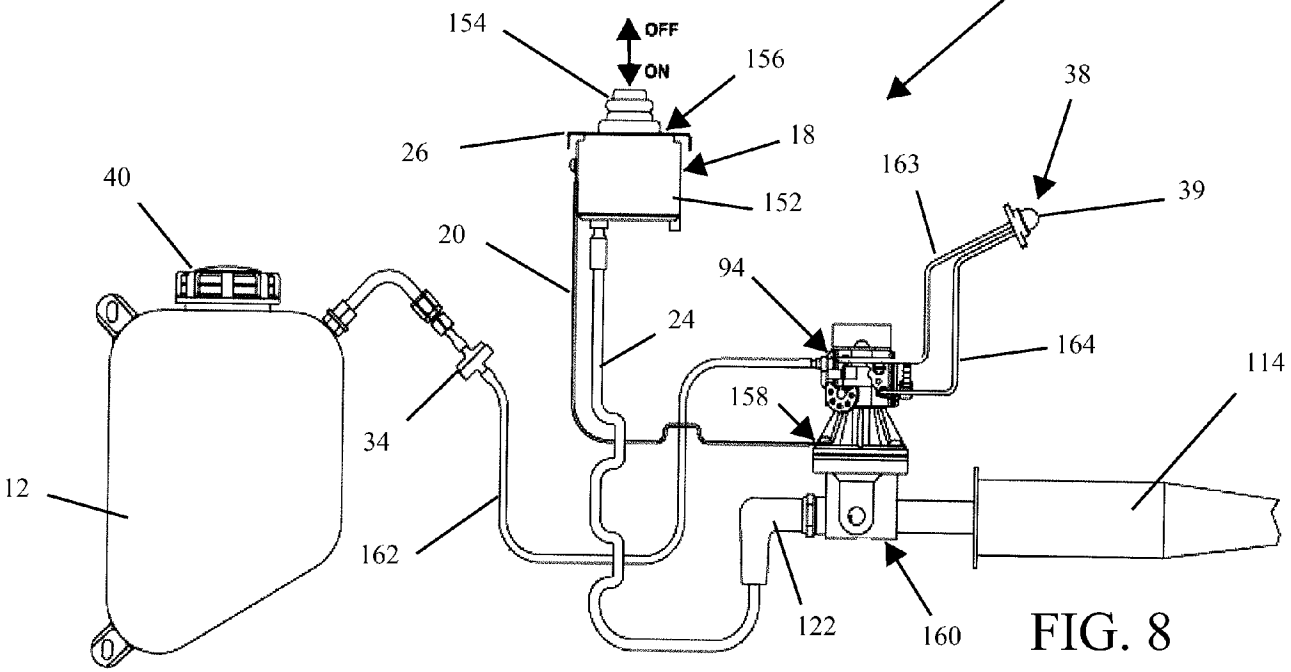
FIG. 8 is a schematic view of an embodiment of an ignition system for a pulse fog generator operating with a low voltage power source.

An advantageous embodiment of an ignition system for a pulse jet generator is illustrated in FIG. 8. In this particular embodiment, the ignition system 16 is operable from a low voltage power source 152. As described above, the low voltage power source 152 may include one or more batteries that provide less than 12 VDC. In the embodiment shown in FIG. 8, the low voltage power source 152 advantageously includes a single AAA battery for producing 1.5 VDC. The low voltage power source 152 reduces the overall weight and cost of the pulse fog generator.

The ignition system 16 of FIG. 8 further includes an ignition switch 154, which as described above with reference to FIG. 5, can be depressed to ignite the combustion process. An ignition wire assembly 24 runs between an igniter 18 of the ignition system 16 and a spark plug 122 for firing the sparkplug and igniting a carburetor 94. The sparkplug 122 may be coupled to an antechamber 160, which is further connected to an antechamber/engine assembly 114 and the carburetor 94.

A fuel tank assembly 12 is shown in FIG. 8 with a fuel tank cap 40. Fuel is transported from the fuel tank assembly 12 through a fuel supply line 162 to the carburetor 94. A fuel filter 34 is coupled at a location along the fuel supply line 162 to prevent dust, dirt, and other unwanted particles from being transported to the carburetor 94.

Also shown in FIG. 8 is a primer bulb assembly 38 which was briefly described above. The primer bulb assembly 38 is mounted to the carburetor 94. The primer bulb assembly 38 includes a priming fuel inlet line 163 through which priming fuel is drawn, and a priming fuel outlet line 164 that opens into a carburetor throat (not shown) at an outlet port (not shown). The primer bulb assembly 38 comprises a flexible resilient bulb 39 which is mounted on a priming valve body (details of the primer bulb assembly are illustrated in FIGS. 7a and 7b of U.S. Pat. No. 4,934,601, which is herein incorporated by reference). The fuel inlet and outlet lines 163 and 164, respectively, are appropriately connected to the priming valve body to communicate with the proper valves of the carburetor 94. In one embodiment, the bulb 39 may be transparent or translucent so that a visual indication is available that priming fuel is present in the bulb for injection into the carburetor.

The operation of the primer bulb assembly 38 is described below and in further detail in U.S. Pat. No. 4,934,601. As the priming bulb 39 is initially depressed, air or fumes in the bulb are expelled from the bulb 39 through an outlet valve (not shown in FIG. 8) and priming fuel outlet line 164 and outlet port into the carburetor 94. When the bulb 39 resiliently returns to its pre-determined undeformed shape, a vacuum is formed inside the bulb that pulls an inlet needle valve (not shown) of the carburetor 94 down and draws fuel from the fuel tank assembly 12 through the carburetor 94, through the priming fuel inlet line 163 and into the primer bulb assembly 38. When the bulb 39 is next depressed, the fuel within the bulb 39 is expelled through the priming fuel outlet line 164 and outlet port into the carburetor throat. When the bulb is depressed, an inlet valve (not shown) seats in its closed position, and when the bulb 39 rebounds to its undeformed shape, the outlet valve (not shown) seats in its closed position. The resilience of the bulb 39 is sufficiently great to draw a vacuum in a metering chamber (not shown) of the carburetor 94 sufficient to pull a metering needle valve (not shown) off its valve seat and to draw starting fuel from the fuel tank assembly 12. With this embodiment, the priming fuel may be injected directly into the carburetor throat, rather than through the metering chamber. In addition, the use of the priming bulb 39 simplifies the connection between the primer bulb assembly 38 and the carburetor body 94 to eliminate pump adaptors of prior art fogger devices.

Referring back to the ignition system 16 of FIG. 8, the igniter 18 is grounded via a primary means and a secondary means. An igniter bracket 26 may be coupled to a main support reference 30 (FIG. 5) of the pulse fog generator and provides a main ground contact 156. As described above with reference to FIG. 5, a thin wire connected to the igniter 18 contacts the chassis and grounds the igniter 18. A second means for grounding the igniter 18 is by coupling a ground wire assembly 20 to the igniter bracket 26 and to a primary grounding point 158 at or near the sparkplug 122. This provides a reliable and safe means for grounding the igniter without relying on the thin wire of the igniter for contacting and/or maintaining contact with the chassis.

As is known with current technology for starting a pulse jet generator, three main systems are required for doing so and these include an ignition system, a fuel system, and an air system. The air system for providing air to the combustion system of the pulse jet generator may include an electrical compressor or pump and/or a mechanical, hand-operated pump. An example of an air system 4 is shown in FIGS. 1-4. Other potential air supply devices may also be incorporated into the design of a pulse fog generator for providing air to the combustion system. An embodiment of the fuel system assembly 12 has been shown and described above, particularly with reference to FIGS. 1-2, 4, and 8. The ignition system, in particular with regards to the embodiments in FIGS. 5, 7, and 8, has been described in greater detail above. The ignition system, and in particular the igniter, is generally tuned to a specific frequency or frequency range before it reaches the consumer. In some embodiments, the igniter cannot be tuned externally, while in other embodiments the igniter may be tuned externally. Igniters, which operate from low voltage power supplies, are generally tuned at different frequencies depending on various factors including the type of power source being used. For example, in standard fogging devices which include 12 VDC or more ignition systems, the frequency may be approximately 1 kHz. However, in the pulse jet generator that includes the ignition system 16 of FIG. 8 which may operate from a 1.5 volt DC power supply, the frequency may be in the range of 10-20 Hz. Thus, the frequency may vary greatly between ignition systems that operate with different power supplies, and specifically pulse jet generators that operate with lower voltage power supplies are tuned to lower frequencies.

Figure 9C:
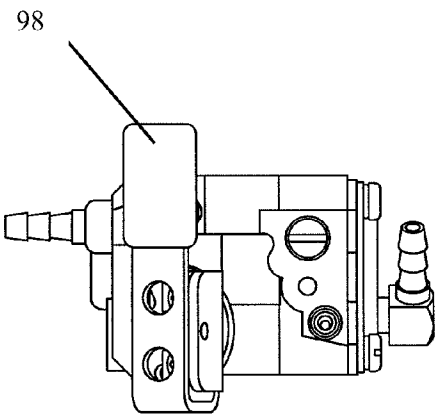
FIG. 9C is a side view of the carburetor of FIG. 9A with the lever in a fully open position.
Figure 9B:
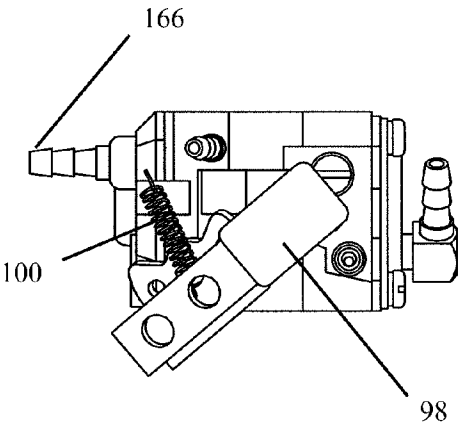
FIG. 9B is a side view of the carburetor of FIG. 9A with the lever at the tipping point.
Figure 9A:
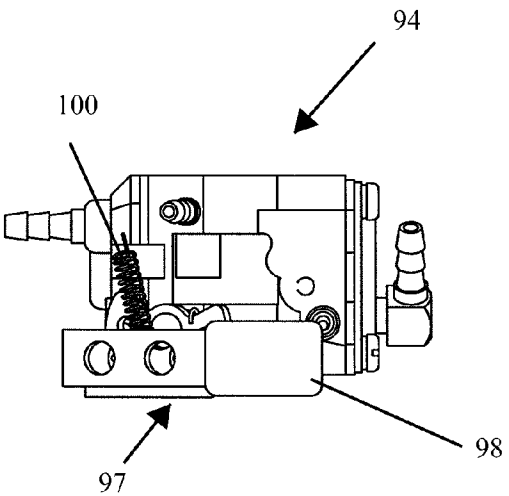
FIG. 9A is a side view of a carburetor with a lever in a fully closed position.

As mentioned above with regards to FIGS. 3 and 6, a pulse fog generator may be turned on and/or off by means of a carburetor power switch assembly 36. An exemplary embodiment of the carburetor power switch assembly 36 is shown in FIGS. 9A-C as a lever assembly 97. The lever assembly 97 is advantageous as it consists of a lever 98 and a spring 100 which mount to a standard carburetor 94. Many carburetor power switch assemblies known to the skilled artisan require more than a dozen components, which makes the assembly and any subsequent repairs to the assembly complicated and burdensome.

During use, the lever 98 operates in a teeter-totter-like manner. Specifically, the lever 98 is in a fully closed position in FIG. 9A. In order to start the pulse fog generator, the lever 98 must be pivoted to the open position of FIG. 9C. To reach the open position, however, the lever 98 must be rotated or moved past a "tipping point" or midpoint along its travel. The spring 100 provides resistance against rotating or moving the lever 98 to the open position until the lever 98 passes the "tipping point" or midpoint of FIG. 9B. After the lever 98 is moved past the "tipping point" or midpoint of FIG. 9B, the spring 100 helps pull the lever 98 to the fully open position of FIG. 9C. Once the lever 98 is positioned in the fully open position, air and fuel are permitted to freely flow into the combustion chamber. Similarly, in rotating or moving from the fully open position of FIG. 9C to the fully closed position of FIG. 9A, the lever 98 must be rotated or moved past the "tipping point" or midpoint of FIG. 9B, and once the lever 98 has done so, the spring 100 may act as a cam to further move the lever 98 to the closed position.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for igniting a pulse fog generator comprising a carburetor, a pump for pumping air into the carburetor, a priming pump for directing a quantity of fuel into the carburetor, and an ignition system including an igniter, the method comprising:

actuating a lever on the carburetor to an open position;

directing air and fuel to flow into the carburetor for combustion;

triggering a switch on the ignition system;

supplying 1.5 volts DC at a frequency of 10 Hz to the igniter; and igniting the pulse fog generator.

2. The method of claim 1, further comprising grounding the igniter to the carburetor by a grounding connection.

3. The method of claim 2, wherein the grounding connection comprises a plate for mounting the igniter to a chassis supporting the pulse fog generator.

4. The method of claim 3, wherein the grounding connection further comprises a secondary ground wire assembly for grounding the igniter to a location substantially near a sparkplug of the pulse fog generator.

5. The method of claim 1, wherein, as the lever is actuated to the open position, the lever is moved past a tipping point and a spring coupled between the lever and the carburetor biases the lever to the open position.

6. The method of claim 1, further comprising moving the lever to a closed position to shutdown the pulse fog generator.

7. The method of claim 6, wherein, as the lever is moved to the closed position, the lever is moved past a tipping point and a spring coupled between the lever and the carburetor biases the lever to the closed position.

* * * * *

UNITED STATES PATENT AND TRADEMARK OFFICE

CERTIFICATE OF CORRECTION

PATENT NO. : 8,006,959 B2
APPLICATION NO. : 12/860798
DATED : August 30, 2011
INVENTOR(S) : Roudebush et al.

It is certified that error appears in the above-identified patent and that said Letters Patent is hereby corrected as shown below:

Title page, section (75), line 1, Noblesville, [TN] is corrected to Noblesville, --IN--

Signed and Sealed this
Twenty-fifth Day of October, 2011

David J. Kappos

David J. Kappos
*Director of the United States Patent and Trademark Office*